US008001661B2

(12) United States Patent
Clark

(10) Patent No.: US 8,001,661 B2
(45) Date of Patent: Aug. 23, 2011

(54) APPARATUS FOR SECURING ORNAMENTATION TO PERSONAL ITEMS

(75) Inventor: M. Paige Clark, Seattle, WA (US)

(73) Assignee: Modern Muse, Inc., Seattle, WA (US)

( * ) Notice: Subject to any disclaimer, the term of this patent is extended or adjusted under 35 U.S.C. 154(b) by 12 days.

(21) Appl. No.: 12/624,024

(22) Filed: Nov. 23, 2009

(65) Prior Publication Data

US 2010/0064484 A1 Mar. 18, 2010

Related U.S. Application Data

(62) Division of application No. 11/293,418, filed on Dec. 1, 2005, now Pat. No. 7,640,636.

(51) Int. Cl.
*A44B 99/00* (2010.01)

(52) U.S. Cl. ..... 24/303; 24/66.1

(58) Field of Classification Search ..... 24/66.1, 24/303, 114.4, 114.12, 104; 463/662, 665; 248/29.2; 292/206.5; 335/285
See application file for complete search history.

(56) References Cited

U.S. PATENT DOCUMENTS

| | | | | |
|---|---|---|---|---|
| 2,601,424 | A * | 6/1952 | Baker | 24/66.1 |
| 2,752,764 | A | 7/1956 | Lederer | |
| 2,975,497 | A | 3/1961 | Budreck | |
| 3,141,216 | A | 7/1964 | Brett | |
| 3,715,781 | A | 2/1973 | Salvatori | |
| 4,231,137 | A | 11/1980 | Fujimoto | |
| 4,776,043 | A | 10/1988 | Coleman | |
| 5,347,733 | A | 9/1994 | Whittington | |
| 5,359,734 | A | 11/1994 | Rathburn | |
| 5,369,899 | A * | 12/1994 | Reeves | 24/303 |
| 5,432,986 | A | 7/1995 | Sexton | |
| 5,473,799 | A | 12/1995 | Aoki | |
| D390,496 | S | 2/1998 | Olsen et al. | D11/87 |
| 5,732,451 | A | 3/1998 | Mars | |
| 5,926,920 | A * | 7/1999 | Denison | 40/1.5 |
| 5,933,926 | A | 8/1999 | Reiter | |
| 5,974,634 | A * | 11/1999 | Eisenpresser | 24/303 |
| 6,009,601 | A | 1/2000 | Kaufman | |
| 6,170,131 | B1 | 1/2001 | Shin | |
| 6,175,963 | B1 | 1/2001 | Loeffelholz | |
| 6,282,760 | B1 | 9/2001 | Mars | |
| 6,422,955 | B1 * | 7/2002 | Lopez | 224/918 |
| 6,519,779 | B1 | 2/2003 | Taguchi | |
| 6,647,597 | B2 | 11/2003 | Reiter | |

(Continued)

FOREIGN PATENT DOCUMENTS

DE 9215520.0 U1 4/1994

(Continued)

*Primary Examiner* — Robert J Sandy
(74) *Attorney, Agent, or Firm* — Seed Intellectual Property Law Group PLLC

(57) ABSTRACT

An ornamental device includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

15 Claims, 3 Drawing Sheets

U.S. PATENT DOCUMENTS

| | | | | |
|---|---|---|---|---|
| 6,892,428 | B2 | 5/2005 | Reiter | |
| 6,904,710 | B2 | 6/2005 | Lawrence et al. | |
| D519,052 | S | 4/2006 | Watanabe | D11/5 |
| 7,065,841 | B2 | 6/2006 | Sjoquist | |
| 7,120,972 | B2 | 10/2006 | O'Banion | |
| 7,178,207 | B2 | 2/2007 | Wong et al. | |
| 7,337,481 | B2 * | 3/2008 | Gilbert | 24/303 |
| 2001/0052245 | A1 | 12/2001 | Lovegrove | |
| 2004/0117894 | A1 | 6/2004 | Kuo | |
| 2004/0154143 | A1 | 8/2004 | Harrell | |
| 2005/0177985 | A1 * | 8/2005 | Sjoquist | 24/104 |

FOREIGN PATENT DOCUMENTS

| | | | |
|---|---|---|---|
| EP | 1374715 | A1 | 1/2004 |
| FR | 2751517 | A1 | 1/1998 |
| FR | 2849750 | A1 | 7/2004 |

* cited by examiner

APPARATUS FOR SECURING ORNAMENTATION TO PERSONAL ITEMS

CROSS-REFERENCE TO RELATED APPLICATION

This application is a divisional of U.S. patent application Ser. No. 11/293,418, filed Dec. 1, 2005, now issued as U.S. Pat. No. 7,640,636, which application is incorporated herein by reference in its entirety.

FIELD OF THE INVENTION

This invention relates to ornamental devices, and more particularly, to a device for securing ornamentation to personal items.

DESCRIPTION OF THE RELATED ART

It is often desirable and fun for people to place ornamental elements on personal items such as clothing, accessories and housewares. One conventional way to accomplish this, is through the use of decorative pins. It is not always possible or desirable, however, to place a pin through a selected personal item. Other conventional methods include stitching or the use of adhesives, both of which have associated drawbacks.

Prior art systems also exist for securing ornamentation to an item through hook and loop fasteners, such as shown in U.S. Pat. Nos. 4,776,043 and 5,359,734. Other conventional systems teach to secure plates of ferrous material to the underside of a garment or in a pocket stitched within a garment, such as shown in U.S. Pat. No. 6,175,963. Such systems have several shortcomings, including being expensive to manufacture, being unattractive, and having low stability such that the magnetic emblem of the prior art may be easily knocked from the personal item.

Applicant therefore believes that it is possible and desirable to provide an improved system for securing ornamentation to a personal item. The present invention provides such a system.

BRIEF SUMMARY OF THE INVENTION

The present invention provides a system for securing an ornamental element to a personal item. As used throughout, "personal item" is meant as a broad term, to encompass such things as an article of clothing, purse, backpack, belt, etc., as well as all manner of housewares, toys, jewelry and items for pets. These potential uses are presented merely by way of example, and the invention is not limited to such uses.

In one embodiment, an ornamental device includes a first member adapted to be coupled to a personal item. While this may be accomplished in any known available way, in one embodiment, the first member is a rivet that is coupled to a personal item in a known manner. Alternatively, the first member is secured to a selected surface, for example by an adhesive.

The first member is provided with a first end having a sidewall. A second member is releasably engagable with the first member, and is provided with a recess that receives the first end of the first member when the first and second members are engaged. The second member is further provided with a flange that contacts the sidewall of the first member substantially along a width of the sidewall when the first and second members are engaged. The first and second members are magnetically coupled. More particularly, one of the first and second members includes a magnetic element, and the other of the first and second members is attractable to a magnet. It will be understood that this may be accomplished through use of a magnet and a ferrous element, or through the use of two magnets.

In one embodiment, a lens is coupled to an upper region of the second member and an ornamental element is provided beneath the lens. In one embodiment, the lens is removably secured to the second member, allowing a user to replace the ornamentation visible through the lens. In other embodiments, the lens is fixed or is eliminated. In these and other embodiments, an upper region of the second member may be provided directly with ornamentation. It will be understood that "ornamentation" as used throughout is a broad, encompassing term, and may take any form, including, but not limited to, the use of jewels, glass, metal working, enamel, embroidery, plastic, etc., and may be decorative or serve an identification function.

The present invention provides many benefits over prior art systems for securing ornamentation to a personal item. More particularly, by securing an ornamental member magnetically to a rivet that is received within a recess of the ornamental member, and by ensuring that a flange of the ornamental member extends along a sidewall of the rivet, lateral stability is provided between the two pieces, further securing the ornamental element to the rivet. Given that rivets are conventional in appearance and inexpensive to install, a user may choose to mount a variety of first members, or rivets, to a personal item and then secure one or more ornamental second members as desired. As discussed above, rather than merely being magnetically attracted, the arrangement of the flange secured over the width of the rivet provides lateral stability, which helps prevent the ornamental item from being accidentally dislodged from the first member.

Furthermore, it is fashionably acceptable to have rivets on personal items. Therefore, even if the user chooses to not use the decorative second members, it will be acceptable to have the first members provided on the personal item alone, unlike prior art systems where failure to have the selected indicia attached to the personal item may result in an exposed metal disc. The present system is therefore more secure, cost-effective, and fashionably acceptable.

BRIEF DESCRIPTION OF THE SEVERAL VIEWS OF THE DRAWING(S)

DETAILED DESCRIPTION OF THE INVENTION

Figure 1:
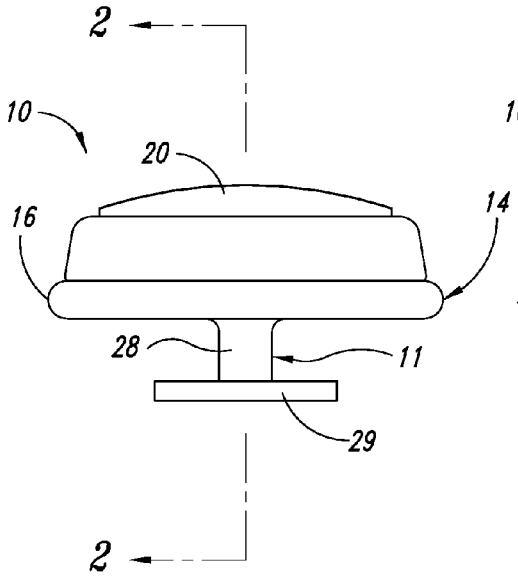
FIG. 1 is a front elevational view of an ornamentation device provided in accordance with the present invention.
Figure 2:
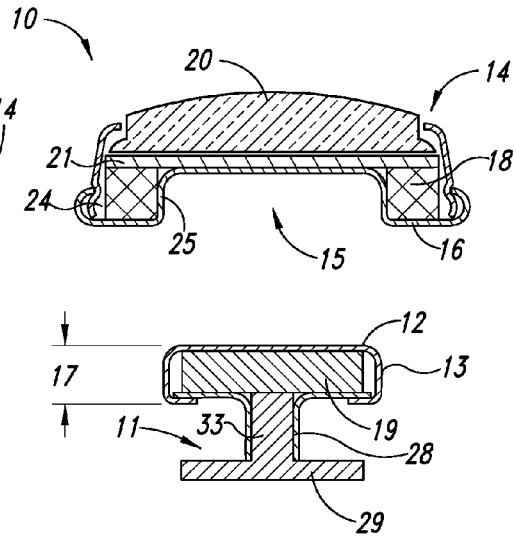
FIG. 2 is an exploded, cross-sectional elevational view of the device of FIG. 1, taken along line 2-2 of FIG. 1.

As illustrated in FIGS. 1 and 2, an ornamentation device 10 provided in accordance with the present invention includes a first member 11 and a second member 14. The first member 11 is provided with a first end 12 having a sidewall 13. The first member 11 is adapted to be coupled to any selected personal item. While this may be accomplished in any known manner, in one embodiment, the first member includes a shaft 28 and a backer 29. Similar to the installation of a rivet, a conventional tool is used to force the post 33 of backer 29 through a selected surface of a personal item into the hollow shaft 28 of the first member 11, thereby securing the first member 11 at a selected location on a personal item, with the first end 12 positioned on one side of a surface of the personal item and the backer 29 positioned on an opposite side of the surface of the personal item.

Figure 3:
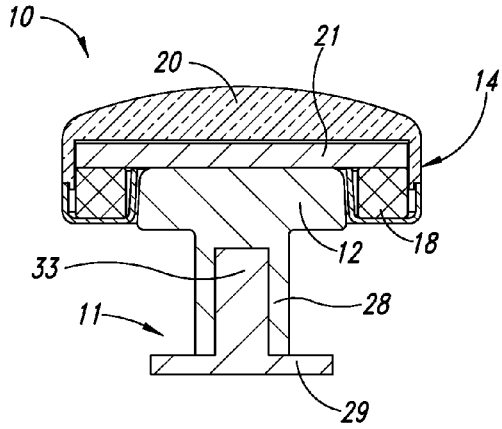
FIG. 3 is a cross-sectional elevational view of an alternative embodiment of the present invention.

As further illustrated in FIGS. 1 and 2, the second member 14 is provided with a recess 15 that is adapted to receive the first end 12 of the first member 11 when the first and second members 11, 14 are engaged. Furthermore, the recess 15 is defined by inner annular wall 25 which forms flange 16, the depth of the recess 15 being selected to ensure that flange 16 contacts the sidewall 13 of the first member 11 substantially along a width 17 of the sidewall when the first and second members are engaged. In addition to the interference fit provided between the recess 15 and the first end 12 of the first member 11, the first and second members 11, 14 are magnetically attracted to each other. More particularly, one of the first and second members is provided with a magnetic element and the other of the first and second members is attractable by a magnet. In one embodiment, as best seen in FIG. 2, the second member 14 is provided with an annular cavity 24 bounded by the inner annular wall 25, and a magnet 18 is positioned within the annular cavity 24. A ferrous disc 19 is positioned in the first end 12 of the first member. Alternatively, as illustrated in FIG. 3, the first member 11 may be made of a ferrous material, eliminating the need for a ferrous disc.

In one embodiment of the invention, a lens 20 is coupled to an upper region of the second member 14, and an ornamental element 21 is positioned beneath the lens 20 to be visible through the lens. In one embodiment, the lens is removably secured to the second member, thereby allowing a user to change the ornamental element positioned within the second member 14. Alternatively, an upper surface of the second member 14 may be provided directly with ornamentation, and the second member may or may not include lens 20.

Figure 4:
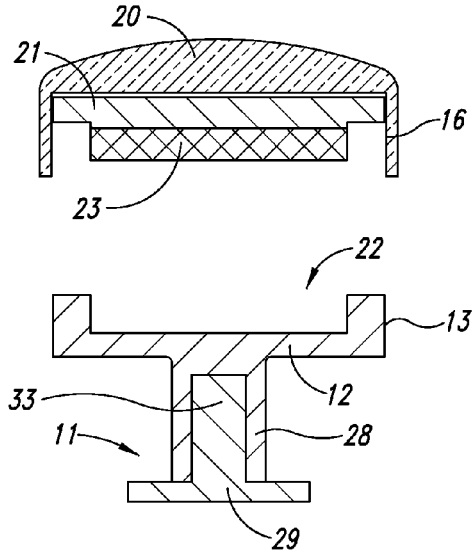
FIG. 4 is a cross-sectional elevational view of another alternative embodiment of the present invention.

In an alternative embodiment, as illustrated in FIG. 4, a depression 22 is provided in the first end 12 of the first member 11. A male member 23 extends downward from an upper surface of recess 15 in the second member 14, such that when the first and second members are engaged, the male member 23 is received within the depression 22 of the first member 11. In one embodiment, the male member 23 is a magnet, and the first member 11 is made of a ferrous material. Similar to previous embodiments, the second member 14 has a flange 16 that extends substantially along the width of the sidewall 13 of the first member 11. In this manner, the first and second members 11, 14, are magnetically coupled, and the interface between flange 16 and sidewall 13 provides lateral stability, thereby further securing the first and second members together. Alternatively, flange 16 of the second member 14 may be omitted. As such, lateral stability is provided by the male member 23 being received within depression 22 and being encircled by sidewall 13.

Figure 5:
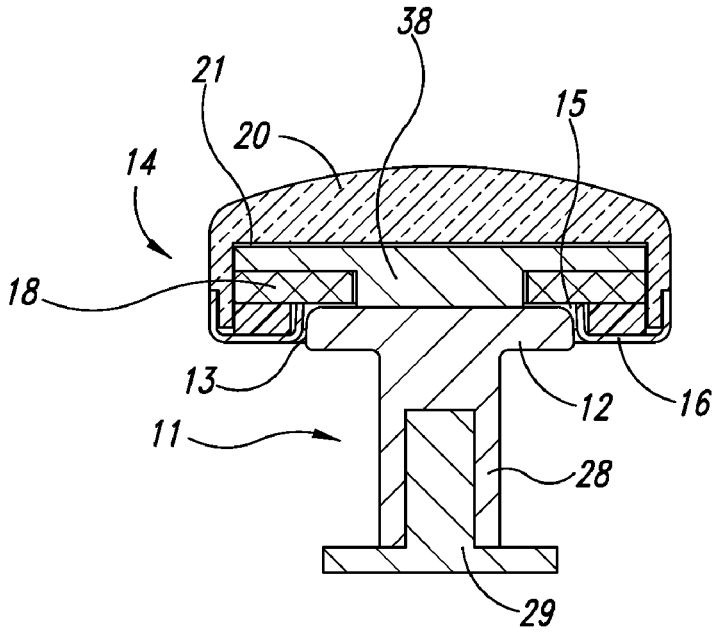
FIG. 5 is a cross-sectional elevational view of another alternative embodiment of the present invention.

Alternatively, as illustrated in FIG. 5, a male member 38 provided in the second member 14 rests against an upper surface of the first end 12 of the first member 11, thereby providing a small gap between magnet 18 and the ferrous first member 11, thereby improving the strength of the magnetic coupling. Again though, similar to the embodiments discussed above, the second member 14 is provided with a flange 16 that defines a recess 15, into which is received the first end 12 of the first member 11. As such, the first and second members 11, 14 are magnetically coupled, and the interface between flange 16 and sidewall 13 provides lateral stability, thereby further securing the first and second members together.

It will be understood that although the illustrated embodiments show a magnet provided in the second member and the first member being attractable by a magnet, this arrangement may be reversed, in that the first member may have a magnet, and the second member may be attractable by a magnet. While this may be accomplished through use of a magnet and a ferrous material, it may also be accomplished through the use of two magnets having reverse polarity. By providing a magnet in the second member, however, the second member 14 may be placed on another surface, for example a refrigerator, to display the ornamental element 21. For purposes of display, it may also be desirable to have a board to which multiple second members are attachable.

Figure 6A:
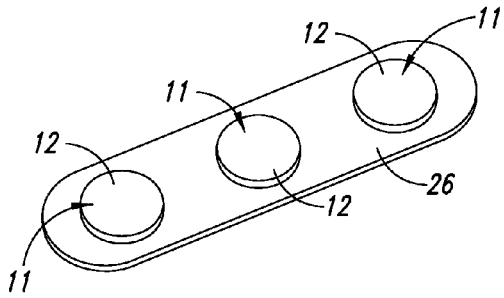
FIG. 6A is an isometric view of a first member of an alternative embodiment of the present invention.
Figure 6B:
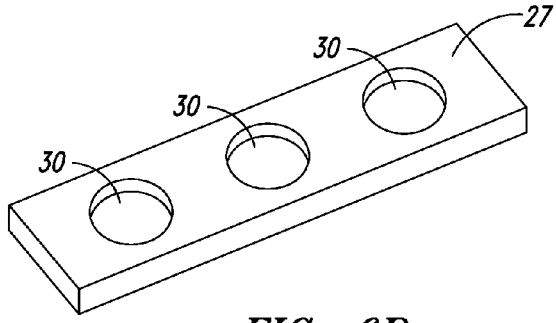
FIG. 6B is an isometric view of a second member for use in combination with the first member of FIG. 6A.
Figure 6C:
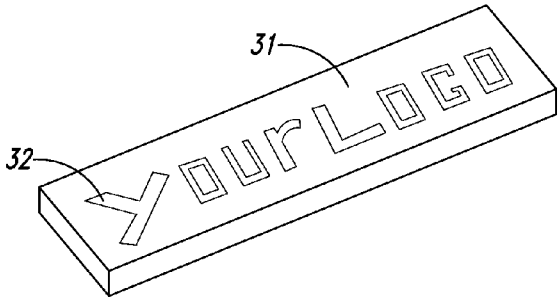
FIG. 6C is an alternative isometric view of the member of FIG. 6B.
Figure 6D:
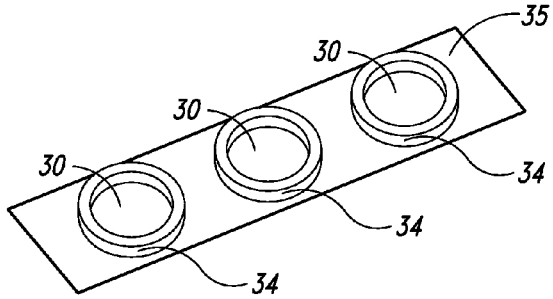
FIG. 6D is an alternative embodiment of a second member for use in combination with the first member of FIG. 6A.

In another embodiment illustrated in FIG. 6A-6C, a spacer 26 is coupled to a plurality of first members 11, holding the first members in fixed positions relative to each other. A second member 27 provided with a plurality of recesses 30 is releasably couplable to the first members, as described above. On a side opposite to recesses 30, an upper region 31 of the second member 27 is provided with any desired ornamentation 32. Such an arrangement may be desirable, for example, when the desired ornamentation is elongated, for example being in the form of a rectangle or oval. In an alternative embodiment, illustrated in FIG. 6D, a plurality of bosses 34 forming recesses 30, are adhered to the backside of a second member 35, which in one embodiment, is flexible, for example, by being made of fabric or plastic.

Figure 7:
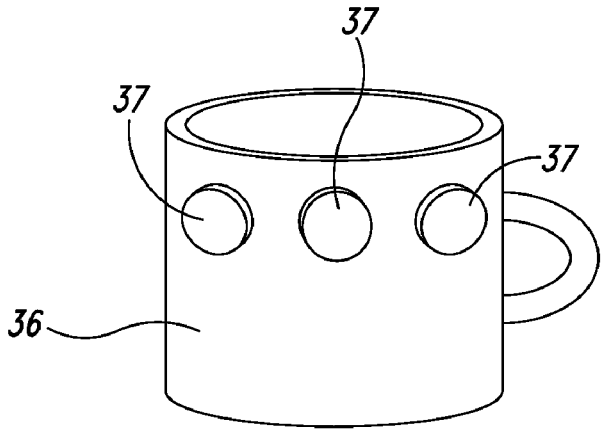
FIG. 7 is an elevational view of the present invention employed on a mug.

It will be understood that while the first member 11 of the present invention may be secured to a selected personal item as conventional rivets are attached to personal items, any available method may be used to secure the first member 11 to a personal item at a selected location. Furthermore, the first member 11 does not need to extend through a personal item, but rather, could be secured to an upper surface of a personal item. For example, a first member 11 could be secured to a hard surface, such as a ceramic or metal surface, for example by an adhesive, thereby allowing decorative second members to be attached to personal items such as plates or coffee mugs. If a first member 11 is attached in this way to a surface, the shaft 28 and backer 29 may be eliminated, such that a first end 12 having a sidewall 13 effectively forming a disc 37, is coupled directed to a selected surface. For purposes of illustration, a plurality of discs 37 are shown coupled to a mug 36 in FIG. 7. It will be understood, however, that such discs may be coupled to any selected hard surface. The discs 37 are in effect the first end 12 of the first member 11 shown throughout the embodiments described above, and may be ferrous or magnetic and may couple with any of the embodiments described above for the various second members.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An ornamentation device comprising:

a first member adapted to be selectively attached to a personal item having an exposed surface, and provided with a first end having a sidewall and a bottom surface contiguous with the sidewall and facing the personal item, the bottom surface of the first end of the first member being in direct contact with the exposed surface of the personal item when the first member is attached to the personal item;

a second member releasably engagable with the first member, the second member having a recess adapted to receive the first end of the first member and having a flange adapted to contact the sidewall substantially along a full width of the sidewall when the first and second members are engaged, an upper surface of the second member being provided with ornamentation that is visible when the first and second members are engaged; and wherein one of the first and second members is provided with a magnetic element and the other of the first and second members is attractable by a magnet.

2. An ornamentation device according to claim 1 wherein a bottom surface of the flange contacts the exposed surface of the personal item when the first member is attached to the personal item and the second member is engaged with the first member.

3. An ornamentation device according to claim 1 wherein the first member is further provided with a second end that extends through a thickness of the personal item when the first member is attached to the personal item.

4. The ornamentation device according to claim 1 wherein the ornamentation is provided on a separate element that is coupled to the upper surface of the second member.

5. The ornamentation device according to claim 1 wherein the first member is provided with a magnet.

6. The ornamentation device according to claim 1 wherein the second member is provided with a magnet.

7. The ornamentation device according to claim 1 wherein the first member is provided with a depression in the first end and a male member is provided in the recess of the second member, such that when the first and second members are engaged, the male member of the second member is received within the depression of the first member.

8. The ornamentation device according to claim 7 wherein the male member is a magnet.

9. The ornamentation device according to claim 7 wherein the first member is made of a ferrous material.

10. An ornamentation device comprising:

a first member adapted to be selectively attached to a personal item having an exposed surface, the first member having a first end provided with a sidewall and a bottom surface contiguous with the sidewall and facing the personal item, the bottom surface of the first end of the first member being in direct contact with the exposed surface of the personal item, and being attractable by a magnet when the first member is attached to the personal item; and a second member having a recess and an annular cavity bounded by an inner annular wall that defines the recess, a magnet being provided within the annular cavity, and wherein the first end of the first member is received within the recess of the second member and the inner annular wall of the second member seats against the sidewall of the first member, when the first and second members are engaged.

11. An ornamentation device according to claim 10 wherein the first member is further provided with a second end that extends through a thickness of the personal item when the first member is attached to the personal item.

12. The ornamentation device according to claim 10 wherein an upper region of the second member is provided with ornamentation.

13. An ornamentation device according to claim 10 wherein a bottom surface of the flange contacts the exposed surface of the personal item when the first member is attached to the personal item and the second member is engaged with the first member.

14. An ornamentation device comprising:

a first member selectively attachable to a personal item, and provided with a first end having a sidewall;

a second member releasably engagable with the first member, the second member having a recess that receives the first end of the first member and having a flange that contacts the sidewall substantially along a width of the sidewall when the first and second members are engaged, an upper surface of the second member being provided with ornamentation that is visible when the first and second members are engaged, and wherein one of the first and second members is provided with a magnetic element and the other of the first and second members is attractable by a magnet; and wherein a bottom surface of the flange contacts the personal item when the first member is attached to the personal item and the second member is engaged with the first member.

15. An ornamentation device according to claim 14 wherein the first member is further provided with a second end that extends through a thickness of the personal item when the first member is attached to the personal item.

* * * * *